US005320558A

United States Patent [19]

von Roretz

[11] Patent Number: 5,320,558

[45] Date of Patent: Jun. 14, 1994

[54] QUICK CONNECT AND DISCONNECT ELECTRICAL TERMINAL

[75] Inventor: Philip von Roretz, Dorval, Canada

[73] Assignee: Supplié & Co. Import/Export Inc., Baie d'Urfé, Canada

[21] Appl. No.: 77,232

[22] Filed: Jun. 14, 1993

[51] Int. Cl.[5] ..... H01R 4/24

[52] U.S. Cl. ..... 439/441

[58] Field of Search ..... 439/436–441

[56] References Cited

U.S. PATENT DOCUMENTS

| | | | |
|---|---|---|---|
| 272,544 | 11/1855 | Strange | 439/441 |
| 2,617,844 | 11/1952 | Sanda | 439/441 |
| 3,099,505 | 7/1963 | Schwartz | 439/441 |
| 3,366,916 | 1/1968 | Oktay . | |
| 3,377,610 | 4/1968 | Busch et al. | 439/441 |
| 4,428,635 | 1/1984 | Hamsher, Jr. et al. . | |
| 4,468,073 | 8/1984 | Machcinski . | |
| 4,981,432 | 1/1991 | Kikuchi . | |

*Primary Examiner*—Joseph H. McGlynn
*Attorney, Agent, or Firm*—Chilton, Alix & Van Kirk

[57] ABSTRACT

A first contact, made of a spring-like material, extends into a housing through the bottom end thereof and adjacent the right end of the housing such that a first portion of the first contact extends into the housing and a second portion extends out of the housing, the first portion being bent back upon itself within the housing. A second contact, also made of a spring-like material, also extends into the housing through the bottom end and adjacent a left end of the housing, once again, such that a first portion of the first contact extends into the housing and a second portion of the second contact extends out of the housing, the first portion of the second contact also being bent back upon itself within the housing. Thus, the two contacts are substantially in the form of an M disconnected at the tip of the apex thereof. An opening extends into the housing from its top end communicating with the apex so that, when an electrical wire is inserted, through the opening, into the housing, it spreads apart the ends of the contacts forming the apex of the M against spring bias so that, when the wire has been inserted, the spring action of the contacts will pressingly engage the electrical wire. Finger operated means are provided for separating the contacts when a wire is held therebetween whereby to release the wire from removal from the electrical terminal.

7 Claims, 2 Drawing Sheets

FIG. 1
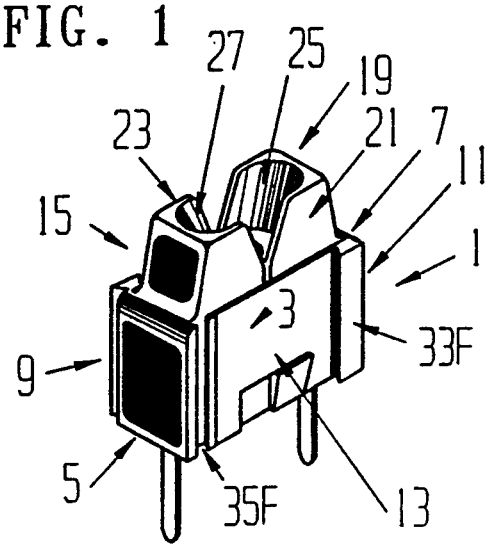
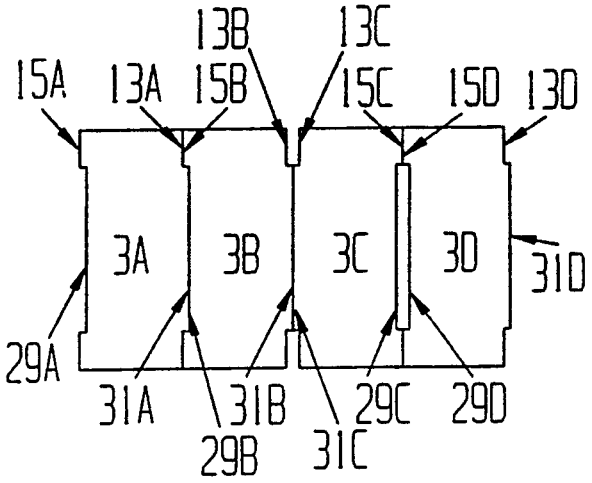
FIG. 2
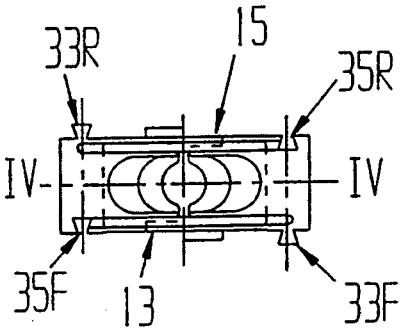
FIG. 3
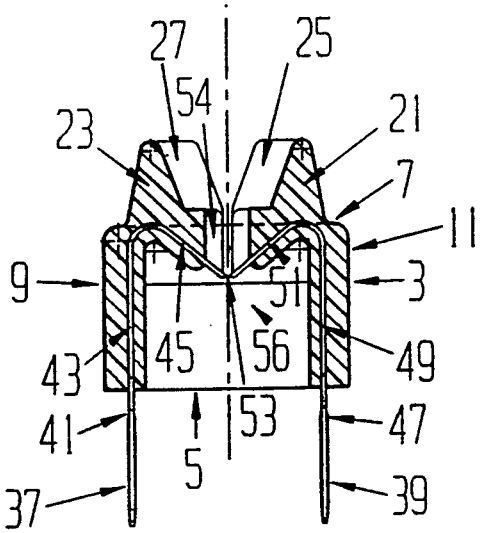
FIG. 4A
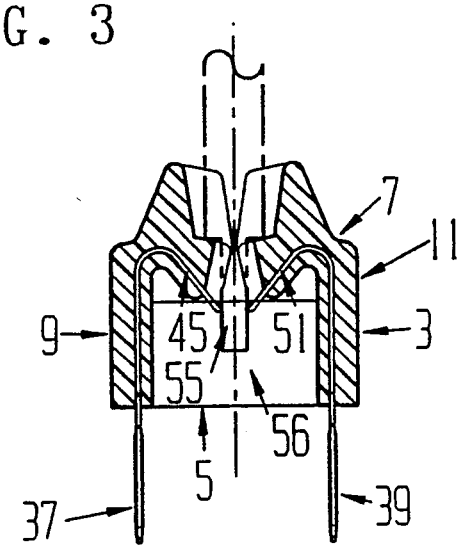
FIG. 4B

QUICK CONNECT AND DISCONNECT ELECTRICAL TERMINAL

BACKGROUND OF INVENTION

1. Field of the Invention

The invention relates to a quick connect and disconnect electrical terminal. More specifically, the invention relates to such an electrical terminal which requires no tools or special attachments for the insertion or removal of electrical wires.

2. Description of Prior Art

Known in the art are many electrical terminals or connectors for electrical wires or the like which use spring-like materials for forming the contacts. Such connectors or terminals are illustrated in U.S. Pat. Nos. 3,336,916, Otay, Jan. 30, 1968, 4,428,635,Hamsher, Jr. et al, Jan. 31, 1984, 4,468,073, Machcinski, Aug. 28, 1984 and 4,981,432, Kikuchi, Jan. 1, 1991.

The '916 patent teaches a connector having fluid pressure relief. A conductor 28 is inserted in the gap between spring contacts 24 and 25. As seen in FIG. 3, the connector is grasped by the spring pressure of the two contacts. To receive the conductor, pressure is applied through the tube 26 whereby to extend the gap between connectors 24 and 25 as shown in FIG. 2. The gap is also extended to remove the conductor from the connector.

The arrangement taught in the '635 patent comprises a connector for daughter boards. As seen in FIGS. 2 to 5 of the patent, the daughter board is held between contacts 48 by the spring-like pressure between these contacts. In accordance with the teachings of the '635 patent cam, illustrated at 16 is needed to open and close the contacts.

The arrangement of the '073 patent is very similar to the arrangement of the '635 patent. As seen in FIGS. 4 and 5, contacts 16 are spring-biassed towards each other and receive an electrical component 12 between them against the pressure of the springs which then holds the electrical component. As described at column 2, lines 58, et seq. of the '073 patent, a lever arm 50 is needed to open and close the contact of this electrical connector.

The '432 patent teaches a connector wherein each contact 14 includes a closed shape interrupted by a gap, or wire receiving portion, 15. Once again, conductors are maintained in the connector by pressure of the two sides of the gap. A special attachment, comprising the cover 12, is needed for disengaging wires held by the electrical connector as described at column 2, lines 10 et seq. of the '432 patent.

It is sometimes awkward to have to operate special attachments when inserting or removing wires from an electrical connector or terminal.

SUMMARY OF INVENTION

It is therefore an object of the invention to provide an electrical terminal which overcomes the disadvantages of the prior art.

It is a more specific object of the invention to provide a quick connect and disconnect electrical terminal which requires no tools or special attachments for the insertion or removal of electrical wires.

In accordance with a particular embodiment of the invention there is provided a quick connect and disconnect electrical terminal, comprising:

a housing member having a top end, a bottom end, a right end and a left end;

a first contact, made of a spring-like material, extending into said housing through said bottom end and adjacent the right end of said housing such that a first portion of said first contact extends into said housing and a second portion extends out of said housing, said first portion being bent back upon itself within said housing;

a second contact, made of a spring-like material, extending into said housing through said bottom end and adjacent the left end of said housing such that a first portion of said first contact extends into said housing and a second portion of said second contact extends out of said housing, said first portion of said second contact being bent back upon itself within said housing;

wherein, said two contacts are substantially in the form of an M disconnected at the tip of the apex thereof;

an opening extending into said housing from said top end and communicating with said apex;

whereby, when an electrical wire is inserted, through that opening, into said housing, it spreads apart the ends of the contacts forming the apex of the M against spring-bias so that, when the wire has been inserted, the spring action of the contacts will pressingly engage said electrical wire;

finger operated means for separating said contacts when an electrical wire is held therebetween whereby to release said electrical wire for removal from said electrical terminal.

BRIEF DESCRIPTION OF DRAWINGS

The invention will be better understood by an examination of the following description, together with the accompanying drawings, in which:

FIG. 1 is a perspective view of one embodiment of an electrical connector in accordance with the invention;

FIG. 2 is a top view of a plurality of interconnected housings;

FIG. 3 is a top view of the terminal illustrated in FIG. 1;

FIGS. 4A and 4B are sections through IV—IV section without an electrical wire inserted and FIG. 4B being a section with an electrical wire inserted;

DESCRIPTION OF PREFERRED EMBODIMENTS

Figure 5:
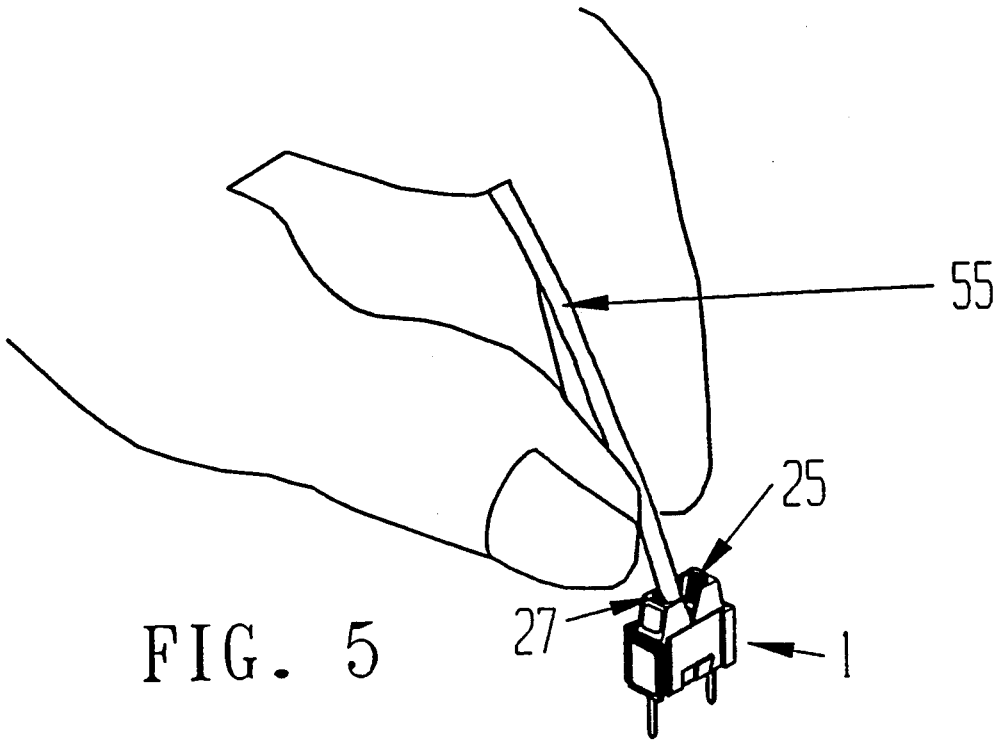
FIG. 5 illustrates how an electrical wire is inserted into the inventive terminal.

Referring to FIG. 1, the electrical terminal is indicated generally at 1 and includes a housing 3 which may be a molded housing. As can be seen, the housing is generally rectangular in shape and includes a bottom end 5, a top end 7, a left end 9, a right end 11, a front wall 13 and a rear wall 15. Mounted on top of the top end 7 is a funnel member 19 having walls 21 and 23. Wall 21 has an inner surface 25 and wall 23 has an inner surface 27, and the inner surfaces 25 and 27 form a funnel-like arrangement.

As will be seen below, means are provided to permit connection of several terminals in side-by-side relationship wherein the front side of one terminal will be connected to either the front or rear side of an adjacent terminal. Spacing means are provided to permit alternate spacing between the centers of two terminals. As seen in FIG. 2, the front wall 13 of each housing includes a spacing depression 29 and the rear wall 15 of housings 3A, 3B, 3C and 3D include depressions 29A, 29B, 29C and 29D respectively as well as protrusions 31A, 31B, 31C and 31D respectively. As can be seen, the protrusions are configured for mating engagement with the depressions. Thus, the width and depth of each protrusion is equal to the width and depth of each depression.

If we assume that the depths of the protrusions and depressions are equal to X, then a connection such as between housings 3B and 3C or between 3C and 3D will be X units greater than the connection between housings 3A and 3B.

Turning to FIG. 3, the means for connecting the terminals in side-by-side relationship comprise connecting protrusions 33F (on the front side of the housing) and 33R (on the rear side of the housing) with mating connecting depressions 35F (on the front side of the housing) and 35R (on the rear side of the housing). As seen in FIG. 1, the connecting depressions 35 and connecting protrusions 33 preferably extend for the full height of the side on which they are disposed. As will be appreciated, in order for such connecting means to work, it will be necessary that the housing be made of a resilient or plastic material.

Turning now to FIGS. 4A and 4B, each terminal includes a first contact 37, made of a spring-like material, which extends into the housing through the bottom end 5 thereof and adjacent the left side 9 of the housing, and a second contact 39 which extends into the housing through the bottom end 5 thereof and adjacent the right side 11 of the housing. The contact 37 includes a first portion 41 which extends outside of the housing and a second portion 43 which extends inside the housing. Inside the housing, the contact 37 is bent back upon itself to provide a bent back portion 45.

In the same way, the contact 39 includes a first portion 47 extending outside of the housing and a second portion 49 extending inside the housing. Once again, inside the housing the contact is bent back upon itself to provide a bent back portion 51. Thus, the contacts 37 and 39 are substantially in the form of an M having an apex 53. The contacts 37 and 39 are disconnected from each other at the apex 53, but are spring-biassed towards each other at the apex 53. An opening 54 extends from the top side 7 of the housing and is in communication with the apex 53 as well as with the funnel formed by inner surfaces 25 and 27. Area 56, below the apex 53, within the housing is, as can be seen in FIGS. 4A and 4B, hollow.

In order to insert a wire into the housing, the wire is guided through the funnel into the opening 54 as shown in FIG. 5. The wire is then pushed against the portions 45 and 51 of the contacts 37 and 39 to separate these portions and to slide therebetween as shown in FIG. 4B. Because of the spring-bias, the edges of the contacts 37 and 39 will pressingly engage the wire 55.

Figure 6:
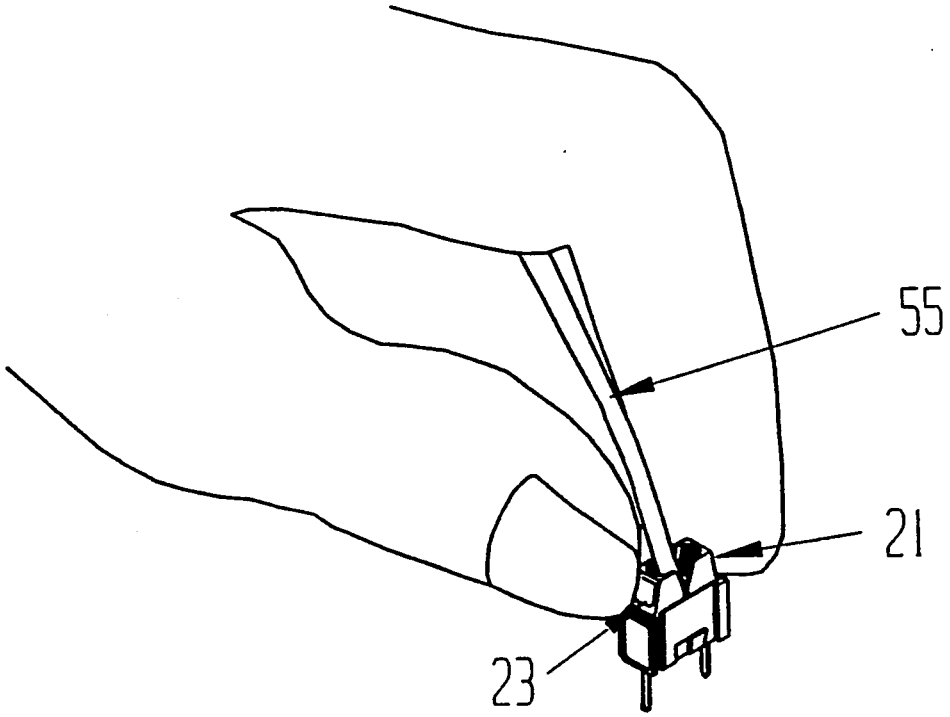
FIG. 6 illustrates how an electrical wire is removed from the inventive terminal.

To remove a wire already inserted, fingers of a user are placed against walls 21 and 23 as shown in FIG. 6 and these walls are then pinched towards each other. This will cause portion 51 to move in a counter-clockwise direction, and portion 45 to move in a clockwise direction, whereby they will be further separated from each other and from the wire 55 so that it will possible to remove wire 55 without exerting any undue force and without damaging the electrical terminal.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A quick connect and disconnect electrical terminal, comprising:

a housing member having a top end, a bottom end, a right end and a left end;

a first contact, made of a spring-like material, extending into said housing through said bottom end and adjacent the right end of said housing such that a first portion of said first contact extends into said housing and a second portion extends out of said housing, said first portion being bent back upon itself within said housing;

a second contact, made of a spring-like material extending into said housing through said bottom end and adjacent the left end of said housing such that a first portion of said first contact extends into said housing and a second portion of said second contact extends out of said housing, said first portion of said second contact being bent back upon itself within said housing;

wherein, said two contacts are substantially in the form of an M disconnected at the tip of the apex thereof;

an opening extending into said housing from said top end and communicating with said apex;

whereby, when an electrical wire is inserted, through that opening, into said housing, it spreads apart the ends of the contacts forming the apex of the M against spring-bias so that, when the wire has been inserted, the spring action of the contacts will pressingly engage said electrical wire;

finger operated means for separating said contacts when an electrical wire is held therebetween whereby to release said electrical wire for removal from said electrical terminal.

2. A terminal as defined in claim 1 and including a funnel member disposed at the top end of said housing;

said funnel member communicating with said opening.

3. A terminal as defined in claim 2 wherein said funnel member comprises a first wall having an inner surface and a second wall having an inner surface;

said inner surfaces forming a funnel-like arrangement.

4. A terminal as defined in claim 3 wherein said housing includes a front wall and a rear wall;

said terminal including means for providing alternate spacing between adjacent terminals, comprising;

a depression in said front wall; and a mating protrusion in said rear wall.

5. A terminal as defined in claim 4 wherein said front wall and said rear walls each have a right edge and a left edge;

a protrusion extending from said front wall at said right edge thereof and said rear wall at said left edge thereof and a protrusion in said front wall at said left edge thereof and said rear wall in said right edge thereof;

said protrusions and depressions being adapted to be mutually engageable.

6. A terminal as defined in claim 5 wherein said molding comprises a resilient or plastic material.

7. A terminal as defined in claim 6 wherein said housing is a molded housing.

* * * * *